US010634346B2

(12) United States Patent
Fernandes Garcia Lima et al.

(10) Patent No.: US 10,634,346 B2
(45) Date of Patent: Apr. 28, 2020

(54) HEATER DEVICE AND METHOD FOR OPERATING A HEATER DEVICE

(71) Applicant: BOSCH TERMOTECNOLOGIA S.A., Cacia Aveiro (PT)

(72) Inventors: Duarte Nuno Fernandes Garcia Lima, Moimenta Da Beira (PT); Joel Filipe Pereira, Aveiro (PT); Luis Miguel Pacheco Monteiro, Aveiro (PT); Mauro André Oliveira Simoes, Oiã (PT); Ricardo Jorge de Sousa Vieira, Maia (PT); Sergio Salustio, Aveiro (PT); Marco Marques, Aveiro (PT)

(73) Assignee: BOSCH TERMOTECNOLOGIA S.A., Cacia Averio (PT)

( * ) Notice: Subject to any disclaimer, the term of this patent is extended or adjusted under 35 U.S.C. 154(b) by 171 days.

(21) Appl. No.: 15/745,159

(22) PCT Filed: Jul. 18, 2016

(86) PCT No.: PCT/EP2016/067007
§ 371 (c)(1),
(2) Date: Jan. 16, 2018

(87) PCT Pub. No.: WO2017/013048
PCT Pub. Date: Jan. 26, 2017

(65) Prior Publication Data

US 2018/0209648 A1 Jul. 26, 2018

(30) Foreign Application Priority Data

Jul. 17, 2015 (PT) ..... 108703

(51) Int. Cl.

| | |
|---|---|
| ***F23N 3/08*** | (2006.01) |
| ***F23N 3/00*** | (2006.01) |
| ***F23N 5/00*** | (2006.01) |

(52) U.S. Cl.
CPC ..... *F23N 3/082* (2013.01); *F23N 3/002* (2013.01); *F23N 5/003* (2013.01); *F23N 2025/16* (2013.01); *F23N 2025/20* (2013.01); *F23N 2025/21* (2013.01); *F23N 2041/04* (2013.01)

(58) Field of Classification Search
CPC ..... F23N 3/002; F23N 3/082; F23N 5/003; F23N 2025/16; F23N 2025/21; F23N 2041/04; F23N 2025/20
See application file for complete search history.

(56) References Cited

FOREIGN PATENT DOCUMENTS

| | | | |
|---|---|---|---|
| DE | 102006047990 | A1 | 4/2008 |
| DE | 102012016606 | A1 | 2/2014 |
| DE | 102014224891 | A1 | 6/2016 |
| EP | 1333227 | A2 | 8/2003 |
| EP | 1522790 | A2 | 4/2005 |

OTHER PUBLICATIONS

International Search Report dated Nov. 7, 2016, of the corresponding International Application PCT/EP2016/067007 filed Jul. 18, 2016.

*Primary Examiner* — Alfred Basichas
(74) *Attorney, Agent, or Firm* — Norton Rose Fulbright US LLP; Gerard Messina

(57) ABSTRACT

A heater device including at least one control and/or regulating unit, which is provided to set an air ratio of a combustion process to a setpoint air ratio. It is provided that the control and/or regulating unit is provided to ascertain a power correction factor in at least one operating state and take it into consideration in the setting of the air ratio.

10 Claims, 2 Drawing Sheets

HEATER DEVICE AND METHOD FOR OPERATING A HEATER DEVICE

BACKGROUND INFORMATION

Gas-fired boilers and/or continuous flow heaters may include a control and/or regulating unit for setting an air ratio to a setpoint air ratio. The setting may take place, for example, based on a temperature of a heating flame, an ionization signal of the heating flame and/or based on an exhaust gas sensor signal.

SUMMARY

The present invention is directed to a heater device including at least one control and/or regulating unit which is provided to set an air ratio of a combustion process, in particular of a mixture, in particular made up of a combustion air and a fuel, to a setpoint air ratio.

It is provided that the control and/or regulating unit is provided to ascertain, in particular to determine and/or advantageously to calculate, a power correction factor in at least one operating state, and take it into consideration in the setting of the air ratio.

In this connection, a "heater device" shall in particular be understood to mean at least a portion, in particular a subassembly, of a heater, and preferably of a continuous flow heater. In particular, the heater device may also include the entire heater and preferably the entire continuous flow heater. In particular, the heater device may include at least one heating unit, at least one metering unit for combustion air, at least one metering unit for fuel and/or at least one sensor.

In this connection, a "heating unit" shall in particular be understood to mean a unit which is provided to convert energy, in particular bio-energy and/or preferably fossil energy, in particular directly, into heat, and supply it in particular to a fluid, advantageously water. In particular, the heating unit includes at least one heating module, which is in particular provided to burn the mixture, in particular made up of the combustion air and the fuel, and advantageously at least one heat exchanger. The heating module is advantageously designed as a burner, in particular an oil burner, and particularly preferably a gas burner, and advantageously has a thermal connection to the heat exchanger for heating the fluid. "Provided" shall in particular be understood to mean specifically programmed, configured and/or equipped. An object being provided for a particular function shall in particular be understood to mean that the object fulfills and/or carries out this particular function in at least one application state and/or operating state.

Furthermore, a "metering unit" shall in particular be understood to mean an, in particular electrical and/or electronic unit, in particular an actuator unit, advantageously a final control unit, which is provided to influence the mixture, in particular made up of the combustion air and the fuel. In particular, the at least one metering unit is provided to set, to regulate and/or to deliver a volume flow and/or a mass flow, in particular a combustion air flow and/or a fuel flow. The metering unit for combustion air may advantageously be designed as a, in particular variable-speed, fan and/or preferably as an, in particular variable-speed, blower. The metering unit for fuel may advantageously be designed as a, in particular variable-throughput, fuel pump and/or preferably as a, in particular variable-throughput, fuel valve. In particular, the metering unit for combustion air and/or the metering unit for fuel are provided to modulate a heating power of the heater device. A "sensor" shall in particular be understood to mean a unit which is provided to detect, in particular at least indirectly and/or advantageously directly, at least one measured variable correlated with the combustion process, in particular at least one pressure, at least one flow rate and/or at least one temperature, in particular of the combustion air, advantageously of the combustion air flow, of the fuel, advantageously of the fuel flow, and/or of the fluid.

Furthermore, an "air ratio" shall in particular be understood to mean a factor, in particular dependent on the combustion air and/or the fuel, which establishes a quality of the combustion process and/or based on which a quality of the combustion process may be inferred. In particular, the air ratio corresponds to a ratio of an amount of combustion air actually present in the mixture, in particular made up of the combustion air and the fuel, to a stoichiometrically required amount of combustion air, which in particular is required for complete combustion. An air ratio having the value 1 corresponds in particular to a stoichiometric combustion air ratio. Advantageously, the air ratio corresponds to a, in particular direct and/or indirect, control and/or regulating variable. Furthermore, a "setpoint air ratio" shall in particular be understood to mean an air ratio at which the combustion process is to take place and/or which results in an optimized combustion process, advantageously a stable heating flame, a minimal harmful substance emission and/or a maximum efficiency. Advantageously, the setpoint air ratio is in a slightly lean mixture range, in particular of the mixture made up of the combustion air and the fuel, and in particular between 1.15 and 1.45, preferably between 1.2 and 1.4, and particularly preferably between 1.25 and 1.35.

A "control and/or regulating unit" shall furthermore in particular be understood to mean an electrical and/or electronic unit having at least one control electronics. A "control electronics" shall in particular be understood to mean a unit including a processing unit and a memory unit, and including an operating, control and/or regulating program which is stored in the memory unit and in particular provided to be executed by the processing unit. In particular, the control and/or regulating unit is provided to provide at least one control signal for setting and/or adjusting at least one metering unit, in particular the metering unit for combustion air and/or the metering unit for fuel. Furthermore, the control and/or regulating unit is provided to provide the heating power, in particular a requested heating power and/or a setpoint heating power, by setting and/or adjusting the at least one metering unit.

In this connection, a "power correction factor" shall in particular be understood to mean a factor which is in particular dependent on the fuel, in particular a composition and/or a type of the fuel, and which is correlated with the heating power, in particular an output power of the heating unit, in particular of the heating module, and/or advantageously an input power of the heating unit, in particular of the heating module. In this connection, an "input power" shall in particular be understood to mean a, in particular maximally achievable, power, in particular thermal power, supplied to the heating unit, in particular the heating module, which would in particular result with a complete and/or optimal combustion of a fuel which is supplied, in particular to the heating unit. The input power is in particular correlated with a chemical energy present and/or stored in the fuel, in particular the fuel supplied to the heating unit. Moreover, an "output power" shall in particular be understood to mean an effective and/or an effectively achievable power, in particular thermal power, which results during the combustion of the fuel, which in particular is supplied to the heating unit. Advantageously, the output power corresponds to a power, in particular thermal power, supplied to the fluid and/or consumed by the fluid. The output power is in particular correlated with a thermal energy which results from the chemical energy of the fuel, in particular during the combustion process. Furthermore, the output power is in particular correlated with the input power via enthalpy, in particular a combustion enthalpy. In particular, the control and/or regulating unit is provided to infer the composition and/or the type of the fuel, such as natural gas and/or liquefied petroleum gas, based on the power correction factor, and to advantageously automatically, and in particular without an intervention of a user, control an operation by setting and/or adjusting the at least one metering unit.

Through an example embodiment of the heater device, in particular a flexibility and/or an efficiency, in particular a power efficiency and/or a cost efficiency, may be increased. Moreover, an autonomously operating heater may advantageously be provided, which in particular is able to automatically, and in particular without an intervention by a user, to identify changing conditions, in particular a changing composition and/or type of a fuel, and to accordingly adapt an operation, whereby in particular costs may be minimized, a functional life increased and maintenance facilitated. Furthermore, an optimized combustion process having a stable heating flame, a minimal harmful substance emission and/or a maximum efficiency may advantageously be ensured, whereby in particular an operational safety may be increased.

Preferably, the power correction factor corresponds to a quotient of a required input power and an actual input power. A "required input power" shall in particular be understood to mean an input power which is required to achieve an output power which is required, in particular by the control and/or regulating unit and/or a user. Furthermore, an "actual input power" shall in particular be understood to mean an instantaneous and/or a present input power. In this way, the power correction factor may particularly advantageously be easily determined and a control algorithm be simplified.

If the control and/or regulating unit is provided to ascertain, in particular to determine and/or, advantageously analytically, calculate, the required input power and/or the actual input power based on an output power which is requested, in particular by the control and/or regulating unit and/or a user, and/or an actual output power and a thermal efficiency, in particular of the combustion process and/or of the heating unit, in particular the heating module, an advantageously precise determination of the power correction factor may be achieved. In this connection, an "actual output power" shall in particular be understood to mean an instantaneous and/or a present output power. The thermal efficiency could be designed as a reference value, for example, and in particular be stored in the memory unit of the control and/or regulating unit. Advantageously, however, the control and/or regulating unit is provided to ascertain the thermal efficiency at least based on an input temperature of the combustion air, in particular of the combustion air flow, and/or of the fuel, in particular of the fuel flow, and/or an exhaust gas temperature of the combustion process. For this purpose, the heater device preferably includes at least three sensors, in particular at least one exhaust gas temperature sensor, which is provided to detect the exhaust gas temperature of the combustion process, and at least one temperature sensor for the combustion air and/or the fuel. In this way, in particular possible signs of aging and/or signs of wear of the heater device, in particular of the heating module, may be taken into consideration, whereby advantageously an accuracy of the power correction factor and/or an operational safety may be increased.

Furthermore, it is provided that the control and/or regulating unit is provided to ascertain, in particular to determine and/or, advantageously analytically, calculate, the requested output power and/or the actual output power based on a temperature of the fluid, in particular an input temperature and/or an output temperature, in particular of the heat exchanger, and/or of a fluid flow, in particular through the heat exchanger. In this case, the heater device advantageously includes at least three sensors, in particular at least two temperature sensors, which are provided to detect the fluid temperature, and at least one flow rate sensor. Due to the use of sensors having a simple design and high durability and/or little aging fluctuations, an advantageously precise measurement may be achieved.

In one embodiment of the present invention, it is provided that the control and/or regulating unit is provided to ascertain, in particular to determine and/or, advantageously analytically, calculate, the power correction factor in the at least one operating state at time intervals of no more than 30 s, advantageously of no more than 10 s, preferably of no more than 5 s and particularly preferably of no more than 1 s. The control and/or regulating unit is advantageously provided to at least essentially continuously ascertain, in particular determine and/or, advantageously analytically, calculate the power correction factor. The expression "at least essentially continuously" shall in particular be understood to mean that the control and/or regulating unit is provided to continuously and/or constantly ascertain the power correction factor within the scope of a processor speed and/or a clock rate of the processing unit. The control and/or regulating unit may advantageously be provided to ascertain, in particular re-ascertain, the power correction factor with every cycle of the processing unit. In this way, in particular an operation of the heater device may advantageously be analyzed, monitored and, in particular as quickly as possible, adapted to changed conditions, in particular of the fuel, whereby an operational safety may advantageously be increased.

The control and/or regulating unit is preferably provided to at least take the power correction factor into consideration for the, in particular analytical, determination and/or calculation of a fuel flow which is required, in particular for a requested output power. In this way, the control and/or regulating unit may advantageously easily take a changed composition and/or type of the fuel into consideration.

Furthermore, it is provided that the control and/or regulating unit is provided to ascertain an actual combustion air flow in at least one operating state and take it into consideration for the, in particular analytical, determination and/or calculation of a required fuel flow. An "actual combustion air flow" shall in particular be understood to mean an instantaneous and/or a present combustion air flow. The actual combustion air flow could be ascertained, for example, with the aid of at least one flow rate sensor, at least one mass flow sensor and/or with the aid of a differential pressure measurement. However, the control and/or regulating unit is advantageously provided to ascertain the actual combustion air flow at least based on a static pressure of the combustion air flow, a power consumption of the metering unit for combustion air, a rotational speed of the metering unit for combustion air and/or a characteristics field, in particular stored in the memory unit of the control and/or regulating unit. The heater device preferably includes at least one sensor, in particular a pressure sensor and/or a power sensor, for this purpose. In this way, an actual combustion air flow may particularly advantageously be easily and/or cost-effectively ascertained. In particular, an operation may be achieved which is independent of possible fluctuations in the combustion air flow, for example due to an air draft.

A particularly easy control may in particular be achieved when the control and/or regulating unit is provided to set and/or control a combustion air flow and a fuel flow independently of one another, advantageously by an independent activation of the metering unit for combustion air and/or of the metering unit for fuel.

Moreover, the present invention is directed to a method for operating a heater device, where an air ratio for a combustion process is set to a setpoint air ratio, and in at least one operating state a power correction factor is ascertained, which is taken into consideration in the setting of the air ratio. In this way, in particular a flexibility and/or an efficiency may advantageously be increased.

The heater device according to the present invention shall not be limited to the above-described application and specific embodiment. In particular, the heater device according to the present invention may include a number of individual elements, components and units which deviates from a number described here to fulfill a functionality described here.

BRIEF DESCRIPTION OF THE DRAWINGS

Further advantages of the present invention may be derived from the description below of the figures. The figures show one exemplary embodiment of the present invention. The figures and the description include numerous features and combinations. Those skilled in the art will advantageously also consider the features individually and combine them into useful further combinations.

DETAILED DESCRIPTION OF EXAMPLE EMBODIMENTS

Figure 1:
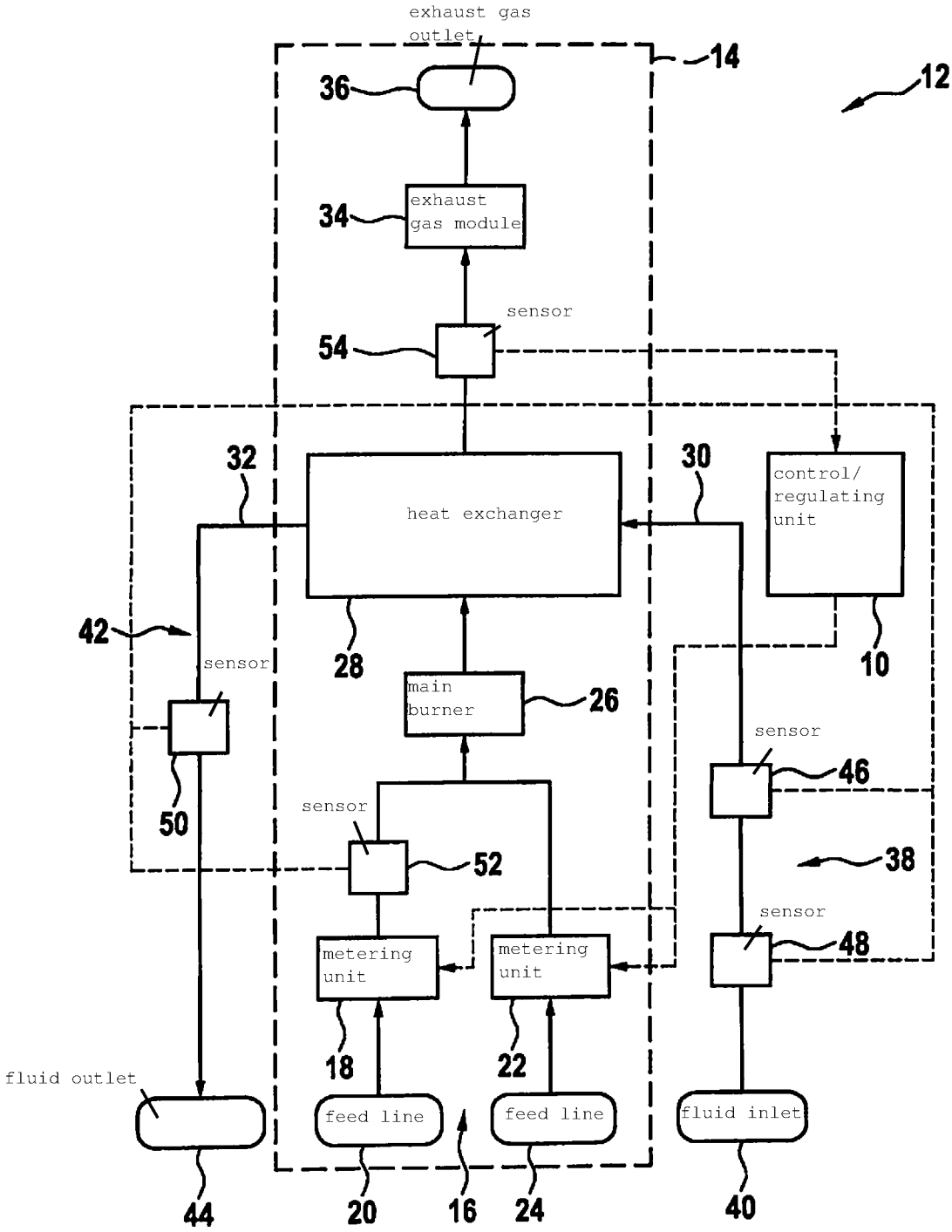
FIG. 1 shows a schematic block diagram of a heater designed as a continuous flow heater including a heater device.

FIG. 1 shows an exemplary heater 12 in a schematic block diagram representation. Heater 12 is designed as a continuous flow heater in the present case. Alternatively, it is possible that the heater is designed as a boiler. Heater 12 includes a heater device.

The heater device includes a heating unit 14. Heating unit 14 is provided to heat a fluid. In the present case, heating unit 14 is provided to heat water. For this purpose, heating unit 14 includes a heating module 16. Heating module 16 is designed as a gas burner module. Alternatively, however, it is also possible that a heating unit is provided to heat a different fluid, such as a cooling medium and/or a heating medium.

Heating module 16 includes a first metering unit 18 for combustion air. First metering unit 18 is designed as a variable-speed blower. First metering unit 18 is provided to deliver and/or to regulate a combustion air flow. For this purpose, first metering unit 18 is connected to a first feed line 20 for combustion air. Moreover, heating module 16 includes a second metering unit 22 for fuel. Second metering unit 22 is designed as a variable-throughput and electronic fuel valve. In the present case, second metering unit 22 is designed as a control valve, in particular as an oscillator coil-modulated flow control valve. Second metering unit 22 is provided to deliver and/or to regulate a fuel flow. In the present case, second metering unit 22 is provided to deliver and/or to regulate a gas. For this purpose, second metering unit 22 is connected to a second feed line 24 for fuel.

Heating module 16 furthermore includes a main burner 26. Main burner 26 is designed as a gas burner in the present case. Main burner 26 is connected via first metering unit 18 to first feed line 20 for combustion air. Moreover, main burner 26 is connected via second metering unit 22 to second feed line 24 for fuel. Main burner 26 is provided to burn a mixture made up of a combustion air and a fuel in at least one operating state. Main burner 26 is provided to generate a heating flame. Additionally, a heating module may include a pilot burner, which in particular is provided to provide a pilot flame for a main burner. Moreover, it is possible to use spark ignition, for example, instead of a pilot burner.

Furthermore, heating unit 14 includes a heat exchanger 28. Heat exchanger 28 is situated in the immediate surroundings of the heating flame. Heat exchanger 28 is provided to transmit thermal energy from heating module 16 to the fluid. For this purpose, heat exchanger 28 includes a feed line 30 for an unheated fluid, in particular water, and an outlet 32 for a heated fluid, in particular water.

Additionally, heating unit 14 includes an exhaust gas module 34. Exhaust gas module 34 is designed as a flue. Exhaust gas module 34 is provided to discharge exhaust gases. For this purpose, exhaust gas module 34 is connected to an exhaust gas outlet 36.

Moreover, the heater device includes a feed unit 38. In the present case, feed unit 38 is provided to feed the unheated fluid to heat exchanger 28 and/or to heater 12. For this purpose, feed unit 38 includes a fluid inlet 40. Fluid inlet 40 is connected to feed line 30 of heat exchanger 28 via a fluid connection.

Furthermore, the heater device includes a discharge unit 42. Discharge unit 42 is provided to discharge the heated fluid from heat exchanger 28 and/or heater 12. For this purpose, discharge unit 42 includes a fluid outlet 44. Fluid outlet 44 is connected to outlet 32 of heat exchanger 28 via a further fluid connection.

Heater device furthermore includes multiple sensors 46, 48, 50, 52, 54. In the present case, heater device includes at least seven sensors 46, 48, 50, 52, 54. Sensors 46, 48, 50, 52, 54 are precalibrated to ensure in particular a high accuracy of the ascertained values. A recalibration and/or readjustment of sensors 46, 48, 50, 52, 54 during operation is dispensed with. A first sensor 46 is designed as a flow rate sensor. First sensor 46 is designed as a vortex flow meter. First sensor 46 is provided to detect a fluid flow. A second sensor 48 is designed as a first temperature sensor. Second sensor 48 is designed as an NTC immersion sensor. Second sensor 48 is provided to detect a fluid temperature. Second sensor 48 is provided to detect a temperature of the fluid immediately downstream from fluid inlet 40 and/or immediately upstream from feed line 30 of heat exchanger 28. A third sensor 50 is designed as a second temperature sensor. Third sensor 50 is designed as an NTC immersion sensor. Third sensor 50 is provided to detect a fluid temperature. Third sensor 50 is provided to detect a temperature of the fluid immediately downstream from outlet 32 of heat exchanger 28 and/or immediately upstream from fluid outlet 44. A fourth sensor 52 is designed as a third temperature sensor. Fourth sensor 52 is provided to detect a temperature of the combustion air, in particular of the combustion air flow. Fourth sensor 52 is provided to detect a temperature of the combustion air, in particular of the combustion air flow, immediately downstream from first metering unit 18 and/or immediately upstream from main burner 26. A fifth sensor 54 is designed as a fourth temperature sensor. Fifth sensor 54 is designed as an exhaust gas temperature sensor. Fifth sensor 54 is provided to detect a temperature of the burned mixture made up of the combustion air and the fuel. Fifth sensor 54 is provided to detect a temperature of the burned mixture immediately downstream from main burner 26 and/or immediately upstream from exhaust gas outlet 36. A sixth sensor (not shown) is designed as a power sensor. The sixth sensor is provided to detect a power consumption of first metering unit 18. A seventh sensor (not shown) is designed as a rotation sensor. For example, the seventh sensor is designed as a magnetic sensor. The seventh sensor is provided to detect a rotational speed of first metering unit 18. The rotational speed is a variable which reflects the revolutions per unit of time, for example the revolutions per minute. As an alternative and/or in addition, it is possible that a heater device includes further sensors, such as at least one pressure sensor and/or at least one temperature sensor for a fuel and/or for a mixture made up of a combustion air and a fuel.

Furthermore, the heater device includes a control and/or regulating unit 10. Control and/or regulating unit 10 is provided to control an operation of the heater device. For this purpose, control and/or regulating unit 10 includes a processing unit, a memory unit, and an operating program which is stored in the memory unit and provided to be executed by the processing unit. Moreover, control and/or regulating unit 10 is provided to set and/or provide a requested heating power. For this purpose, control and/or regulating unit 10 has an electrical connection to first metering unit 18 and second metering unit 22. In the present case, control and/or regulating unit 10 is provided to set the combustion air flow and the fuel flow independently of one another with the aid of first metering unit 18 and second metering unit 22. Moreover, control and/or regulating unit 10 has an electrical connection to sensors 46, 48, 50, 52, 54.

Control and/or regulating unit 10 is provided to set an air ratio $\lambda_c$ of the combustion process to a setpoint air ratio $\lambda_d$. Furthermore, control and/or regulating unit 10 is provided to ascertain a power correction factor $C_F$ in at least one operating state and take it into consideration in a setting of air ratio $\lambda_c$ to setpoint air ratio $\lambda_d$.

Figure 2:
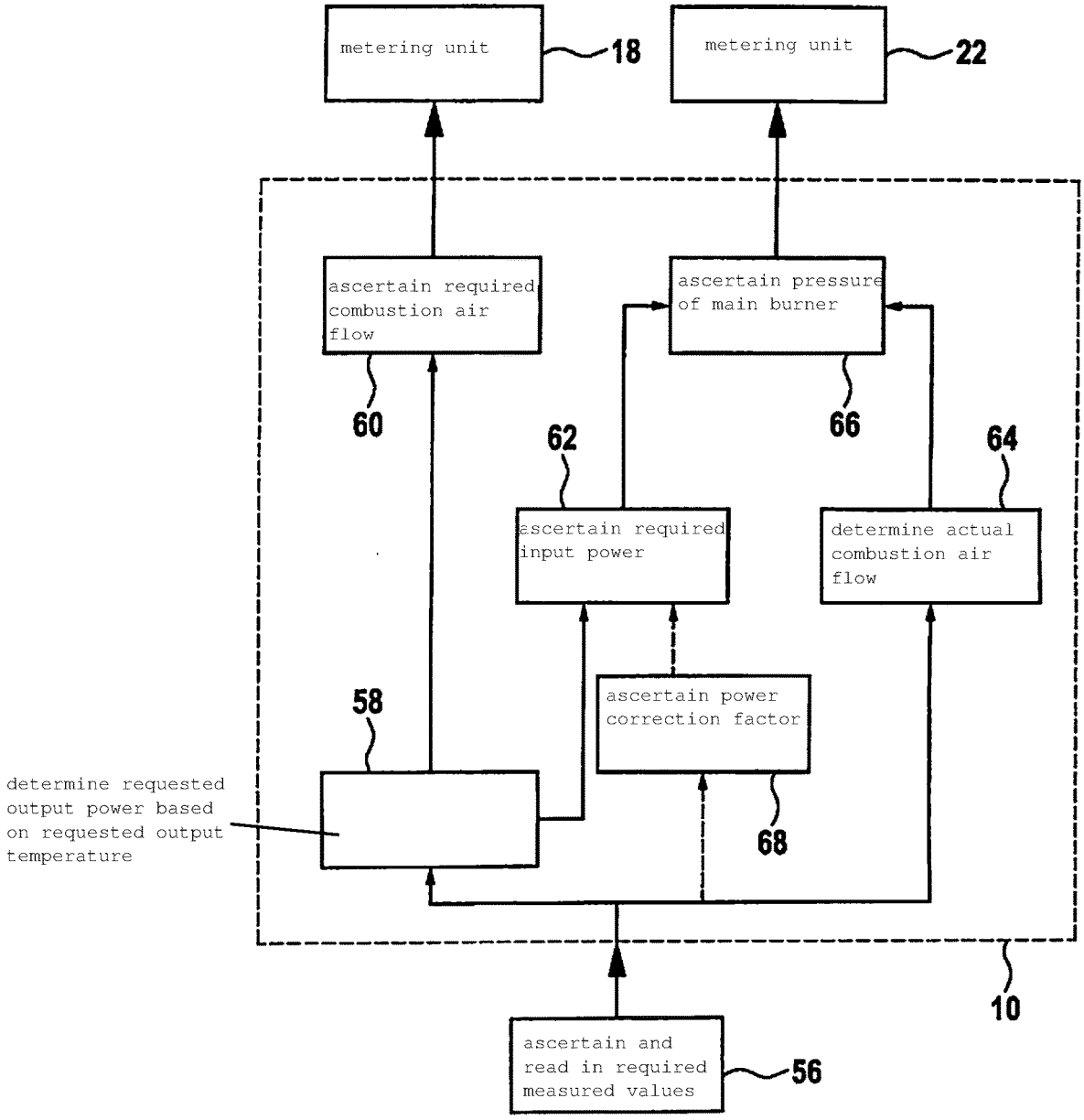
FIG. 2 shows a block diagram for an exemplary operation of the heater device.

The equations required for this purpose, which are in particular stored in the memory unit of control and/or regulating unit 10, are summarized hereafter, while an exemplary operation is described below with reference to FIG. 2.

Control and/or regulating unit 10 is provided to set air ratio $\lambda_c$ to setpoint air ratio $\lambda_d$ as a function of the combustion air flow, in particular of a required combustion air flow $Q_{air,d}$ and/or an actual combustion air flow $Q_{gas,c}$ and the fuel flow, in particular of a required fuel flow $Q_{gas,d}$ and/or an actual fuel flow $Q_{gas,c}$. The variables are correlated with one another as follows:

$$\lambda_i = Q_{air,i}/Q_{gas,i} \tag{1}$$

Moreover, control and/or regulating unit 10 is provided to ascertain an output power, in particular a requested output power $P_{out,d}$ and/or an actual output power $P_{out,c}$, based on a temperature of the fluid, in particular a requested output temperature $T_{out,c}$ of the fluid, an actual output temperature $T_{out,c}$ of the fluid ascertained with the aid of third sensor 50 and/or an input temperature $T_{in}$ of the fluid ascertained with the aid of second sensor 48, and a fluid flow $q_m$. For this applies:

$$P_{out,i} = q_m \cdot c_p \cdot (T_{out,i} - T_{in}) \tag{2}$$

The fluid flow $q_m$ corresponds to a flow rate of the fluid ascertained with the aid of first sensor 46, and $c_p$ corresponds to a calorific value of the fluid.

Furthermore, control and/or regulating unit 10 is provided to ascertain an input power, in particular a required input power $P_{in,d}$ and/or an actual input power $P_{in,c}$, based on the output power, in particular the requested output power $P_{out,d}$ and/or the actual output power $P_{out,c}$, and a thermal efficiency 11 of heating module 16. For this applies:

$$P_{in,i} = P_{out,i} \tag{3}$$

In the present case, control and/or regulating unit 10 is provided to ascertain thermal efficiency $\eta$ at least based on an input temperature of the combustion air ascertained with the aid of fourth sensor 52 and an exhaust gas temperature ascertained with the aid of fifth sensor 54, by which in particular possible signs of aging of heating module 16 may be considered. Since such an ascertainment of thermal efficiency $\eta$ in particular is only valid in a slightly lean mixture range ($\lambda_c > 1$) of the mixture made up of the combustion air and the fuel, control and/or regulating unit 10 is furthermore provided to ascertain a mixture range in which the combustion takes place. Control and/or regulating unit 10 takes advantage of the property that in the lean mixture range an increase in the fuel flow, at a constant combustion air flow, results in an increase in the output power, while this is not the case in a rich mixture range ($\lambda_c < 1$). Moreover, control and/or regulating unit 10 is provided to ascertain air ratio $\lambda_c$ based on the exhaust gas temperature.

Additionally, the following relationship applies for required input power $P_{in,d}$:

$$P_{in,d} = Q_{ges,d} \cdot P_1 = C_n \cdot W_i (2 \cdot \Delta_p)^{(1/2)} = C_n \cdot W_{i,ref} \cdot C_F \cdot (2 \cdot \Delta_p)^{(1/2)} \tag{4}$$

where $$Q_{gas,d} = C_n \cdot [(2 \cdot \Delta_p)/\rho]^{(1/2)} \tag{5}$$

$$P_{in,d}/P_{in,c} = C_F \tag{6}$$

$$P_{in,c}(\text{gas1})/P_{in,c}(\text{gas2}) = W_i(\text{gas1})/W_i(\text{gas2}) \tag{7}$$

and $$\Delta_p = p_B - p_{air}$$

$P_i$ corresponds to a calorific value of heating unit 14, $C_n$ to a flow rate coefficient of a main burner nozzle, $W_i$ to a Wobbe index of a present fuel, $W_{i,ref}$ to a Wobbe index of a reference fuel, $C_F$ to the power correction factor, $\rho$ to a density of the fuel, $p_B$ to a pressure of the main burner and/or a back pressure of the main burner nozzle, and $p_{air}$ to a pressure of the combustion air and/or a counter pressure of the main burner nozzle. Moreover, power correction factor $C_F$ corresponds to a quotient of required input power $P_{in,d}$ and actual input power $P_{in,c}$. If main burner 26 is operated with the reference fuel, power correction factor $C_F$ is indicated by the value 1. In the present case, power correction factor $C_F$ thus corresponds to a factor dependent on the present fuel.

Moreover, in the present case control and/or regulating unit 10 is provided to determine an air ratio correction factor $f_\lambda$ dependent on power correction factor $C_F$, and to take it into consideration in the determination of air ratio $\lambda_c$ and/or setpoint air ratio $\lambda_d$, in particular in equation (1). A corrected equation (1) thus reads:

$$\lambda_i = f_\lambda(C_F) \cdot Q_{air,i}/Q_{gas,i} \tag{9}$$

A difference between equation (1) and equation (9), however, is less than 5%, so that a determination of air ratio correction factor $f_\lambda$ may also be dispensed with.

If a heated fluid, and thus a certain output temperature $T_{out,d}$, is requested by control and/or regulating unit 10 and/or by a user, control and/or regulating unit 10 is provided to ascertain required combustion air flow $Q_{air,d}$ and required fuel air flow $Q_{gas,d}$ for requested output power $P_{out,d}$, and in particular to accordingly adapt actual combustion air flow $Q_{air,c}$ and actual fuel flow $Q_{gas,c}$. The individual operating steps for this purpose are illustrated in FIG. 2 based on an exemplary block diagram, a sequence of the individual operating steps being at least partially variable.

In an operating step 56, control and/or regulating unit 10 is provided to ascertain and read in required measured values with the aid of sensors 46, 48, 50, 52, 54.

In an operating step 58, control and/or regulating unit 10 is provided to determine requested output power $P_{out,d}$ based on requested output temperature $T_{out,d}$, and in particular using equation (2).

In an operating step 60, control and/or regulating unit 10 is provided to ascertain required combustion air flow $Q_{air,d}$ based on requested output power $P_{out,d}$, and in particular using equation (9) or alternatively equation (1), and to accordingly readjust first metering unit 18.

In an operating step 62, control and/or regulating unit 10 is provided to ascertain required input power $P_{in,d}$ based on requested output power $P_{out,d}$, based on thermal efficiency $\eta$, and in particular using equation (3).

In an operating step 64, control and/or regulating unit 10 is provided to determine an actual combustion air flow $Q_{air,c}$. In the present case, control and/or regulating unit 10 is provided to ascertain actual combustion air flow $Q_{air,c}$ based on a rotational speed of metering unit 18 ascertained with the aid of the seventh sensor and a characteristics field stored in the memory unit of control and/or regulating unit 10. Alternatively, however, it is also possible that a control and/or regulating unit 10 is provided to ascertain an actual combustion air flow based on a power consumption of first metering unit 18 ascertained with the aid of the sixth sensor, a rotational speed of first metering unit 18, which is known to control and/or regulating unit 10 based on an activation of first metering unit 18, and a characteristics field stored in the memory unit of control and/or regulating unit 10. Such a method is described in German Patent Application No. DE 10 2012 016 606 A1, for example. Alternatively, however, it is also possible that a control and/or regulating unit is provided to ascertain an actual combustion air flow with the aid of at least one flow rate sensor, at least one mass flow sensor and/or with the aid of a differential pressure measurement. Moreover, control and/or regulating unit 10 is provided to infer the pressure of combustion air $p_{air}$ based on actual combustion air flow $Q_{air,c}$.

In an operating step 66, control and/or regulating unit 10 is provided to ascertain the pressure of main burner $p_B$ based on required input power $P_{in,d}$ and the pressure of combustion air $p_{air}$, and in particular using equations (4) and (8). Subsequently, control and/or regulating unit 10 is provided to ascertain required fuel flow $Q_{gas,d}$, in particular based on equation (5), and to accordingly readjust second metering unit 22. Accordingly, control and/or regulating unit 10 is provided to take actual combustion air flow $Q_{air,c}$ into consideration for the determination of required fuel flow $Q_{gas,d}$.

Moreover, control and/or regulating unit 10 is provided to take power correction factor $C_F$ into consideration for the determination of required fuel flow $Q_{gas,d}$. In the present case, control and/or regulating unit 10 is provided to ascertain power correction factor $C_F$ in an operating step 68 and to take it into consideration in operating step 62.

To ascertain power correction factor $C_F$, control and/or regulating unit 10 is provided to determine actual output power $P_{out,c}$ based on actual output temperature $T_{out,c}$, and in particular using equation (2). Moreover, control and/or regulating unit 10 is provided to ascertain actual input power $P_{in,c}$ based on actual output power $P_{out,c}$, and in particular using equation (3). Power correction factor $C_F$ then results as the ratio between required input power $P_{in,d}$ and actual input power $P_{in,c}$, and in particular based on equation (6).

Control and/or regulating unit 10 is provided to adapt required input power $P_{in,d}$ with the aid of correction factor $C_F$. For this purpose, control and/or regulating unit 10 is provided to ascertain power correction factor $C_F$ in the at least one operating state at time intervals of 0.5 s, and to at least essentially continuously adapt required input power $P_{in,d}$ with the aid of power correction factor $C_F$. For this applies:

$$C_F(n)=P_{in,d}/P_{in,c}\cdot C_F(n-1) \tag{10}$$

$C_F(n-1)$ corresponds to a power correction factor $C_F$ at point in time n−1, and $C_F(n)$ corresponds to a power correction factor $C_F$ at point in time n. In the present case, points in time n and n−1 have a difference of 0.5 s. In this way, control and/or regulating unit 10 is able to infer a composition and/or a type of the fuel and, in the event of a change in the composition and/or the type of fuel, to adapt first metering unit 18 and/or second metering unit 22 relatively quickly and automatically to these new conditions.

What is claimed is:

1. A heater device, comprising:

a heating unit having a heating module, wherein the heating module includes a first metering unit to deliver and/or regulate a combustion air flow and further includes a second metering unit having a control valve to deliver and/or regulate a gas, wherein the first metering unit is coupled to a first feed line for combustion air, and wherein the second metering unit is coupled to a second feed line for fuel;

at least one control and/or regulating unit configured to set an air ratio of a combustion process to a setpoint air ratio;

a plurality of pre-calibrated sensors, including at least a flow sensor, an immersion sensor, a power sensor, and a temperature sensor; and a discharge unit;

wherein the control and/or regulating unit is configured to ascertain a power correction factor in at least one operating state and take the ascertained power correction factor into consideration in the setting of the air ratio, wherein the heating module includes a main burner, which is coupled via the first metering unit to the first feed line for the combustion air, wherein the main burner is configured to burn a mixture of the combustion air and the fuel in at least one operating state, wherein the heating unit includes a heat exchanger situated adjacent to heat provided by the main burner, wherein the heat exchanger includes a feed line for an unheated fluid and an outlet for a heated fluid, wherein the heating unit, which is coupled to an exhaust gas outlet, includes an exhaust gas module to discharge exhaust gases via the exhaust gas outlet, wherein the discharge unit is configured to discharge the heated fluid from the heat exchanger and/or the heater, and includes a fluid outlet, which is connected to an outlet of the heat exchanger via a further fluid connection, and wherein the control and/or regulating unit is coupled to the first metering unit and the second metering unit and to the plurality of sensors.

2. The heater device as recited in claim 1, wherein the power correction factor corresponds to a quotient of a required input power and an actual input power.

3. The heater device as recited in claim 2, wherein the control and/or regulating unit is configured to ascertain at least one of the required input power and the actual input power, based on at least one of: (i) a requested output power, and (ii) an actual output power and a thermal efficiency.

4. The heater device as recited in claim 3, wherein the control and/or regulating unit is configured to ascertain at least one of the requested output power and the actual output power, based on a temperature of at least one of a fluid and a fluid flow.

5. The heater device as recited in claim 1, wherein the control and/or regulating unit is configured to ascertain the power correction factor in the at least one operating state at time intervals of no more than 30 s.

6. The heater device as recited in claim 1, wherein the control and/or regulating unit is configured to take at least the power correction factor into consideration for the determination of a required fuel flow.

7. The heater device as recited in claim 1, wherein the control and/or regulating unit is configured to ascertain an actual combustion air flow in at least one operating state and take the ascertained actual combustion air flow into consideration for the determination of a required fuel flow.

8. The heater device as recited in claim 1, wherein the control and/or regulating unit is configured to set a combustion air flow and a fuel flow independently of one another.

9. A continuous flow heater, comprising:

at least one heater device having at least one control and/or regulating unit configured to set an air ratio of a combustion process to a setpoint air ratio;

wherein the control and/or regulating unit is configured to ascertain a power correction factor in at least one operating state and take the ascertained power correction factor into consideration in the setting of the air ratio, and wherein the heater device further includes:

a heating unit having a heating module, wherein the heating module includes a first metering unit to deliver and/or regulate a combustion air flow and further includes a second metering unit having a control valve to deliver and/or regulate a gas, wherein the first metering unit is coupled to a first feed line for combustion air, and wherein the second metering unit is coupled to a second feed line for fuel;

a plurality of pre-calibrated sensors, including at least a flow sensor, an immersion sensor, a power sensor, and a temperature sensor; and a discharge unit;

wherein the control and/or regulating unit is configured to ascertain a power correction factor in at least one operating state and take the ascertained power correction factor into consideration in the setting of the air ratio, wherein the heating module includes a main burner, which is coupled via the first metering unit to the first feed line for the combustion air, wherein the main burner is configured to burn a mixture of the combustion air and the fuel in at least one operating state, wherein the heating unit includes a heat exchanger situated adjacent to heat provided by the main burner, wherein the heat exchanger includes a feed line for an unheated fluid and an outlet for a heated fluid, wherein the heating unit, which is coupled to an exhaust gas outlet, includes an exhaust gas module to discharge exhaust gases via the exhaust gas outlet, wherein the discharge unit is configured to discharge the heated fluid from the heat exchanger and/or the heater, and includes a fluid outlet, which is connected to an outlet of the heat exchanger via a further fluid connection, and wherein the control and/or regulating unit is coupled to the first metering unit and the second metering unit and to the plurality of sensors.

10. A method for operating a heater device, the method comprising:

setting an air ratio for a combustion process to a setpoint air ratio; and ascertaining, in at least one operating state, a power correction factor which is taken into consideration in the setting of the air ratio;

wherein the heater device includes:

a heating unit having a heating module, wherein the heating module includes a first metering unit to deliver and/or regulate a combustion air flow and further includes a second metering unit having a control valve to deliver and/or regulate a gas, wherein the first metering unit is coupled to a first feed line for combustion air, and wherein the second metering unit is coupled to a second feed line for fuel;

at least one control and/or regulating unit configured for the setting of the air ratio for the combustion process to the setpoint air ratio;

a plurality of pre-calibrated sensors, including at least a flow sensor, an immersion sensor, a power sensor, and a temperature sensor; and a discharge unit;

wherein the control and/or regulating unit is configured to ascertain a power correction factor in at least one operating state and take the ascertained power correction factor into consideration in the setting of the air ratio, wherein the heating module includes a main burner, which is coupled via the first metering unit to the first feed line for the combustion air, wherein the main burner is configured to burn a mixture of the combustion air and the fuel in at least one operating state, wherein the heating unit includes a heat exchanger situated adjacent to heat provided by the main burner, wherein the heat exchanger includes a feed line for an unheated fluid and an outlet for a heated fluid, wherein the heating unit, which is coupled to an exhaust gas outlet, includes an exhaust gas module to discharge exhaust gases via the exhaust gas outlet, wherein the discharge unit is configured to discharge the heated fluid from the heat exchanger and/or the heater, and includes a fluid outlet, which is connected to an outlet of the heat exchanger via a further fluid connection, and wherein the control and/or regulating unit is coupled to the first metering unit and the second metering unit and to the plurality of sensors.

* * * * *